US006698263B2

(12) United States Patent
Hsieh

(10) Patent No.: US 6,698,263 B2
(45) Date of Patent: Mar. 2, 2004

(54) REMOTE-CONTROLLED DOOR LOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 0 days.

(21) Appl. No.: 10/199,073

(22) Filed: Jul. 22, 2002

(65) Prior Publication Data

US 2004/0011094 A1 Jan. 22, 2004

(51) Int. Cl.[7] ..... E05B 63/00; E05B 47/00

(52) U.S. Cl. ..... 70/257; 70/107; 70/108; 70/279.1; 70/280

(58) Field of Search ..... 70/107, 108, 256, 70/257, 280, 281, 282, 279.1; 292/144

(56) References Cited

U.S. PATENT DOCUMENTS 1,358,445 A * 11/1920 Hermanowich ..... 70/108
4,677,834 A * 7/1987 Hicks ..... 70/279.1
4,730,471 A * 3/1988 Seckinger et al. ..... 70/277
4,784,415 A * 11/1988 Malaval ..... 292/144
5,386,713 A * 2/1995 Wilson ..... 70/280
5,626,039 A * 5/1997 Solari et al. ..... 70/279.1
5,852,944 A * 12/1998 Collard et al. ..... 70/278.7
5,862,693 A * 1/1999 Myers et al. ..... 70/278.1
5,987,818 A * 11/1999 Dabideen ..... 49/280
6,035,676 A * 3/2000 Hudspeth ..... 70/278.1
6,079,755 A * 6/2000 Chang ..... 292/144

FOREIGN PATENT DOCUMENTS

FR 2653480 A1 * 4/1991
GB 2193994 A * 2/1988
GB 2196382 A * 4/1988

* cited by examiner

*Primary Examiner*—Anthony Knight
*Assistant Examiner*—Michael J. Kyle

(57) ABSTRACT

A remote-controlled door lock includes a housing installed inside with a battery base, a circuit board and an electromagnetic valve. The electromagnetic valve is fitted with a lateral valve rod controlled by the circuit board to extend out of the through hole in a sidewall of the housing and engage in the insert hole in a sidewall of the bolt base of a doorjamb. A remote controller is operated to control the valve rod of electromagnetic valve to move outward and extend out of the through hole of the housing and engage in the insert hole of the bolt base to lock the door at a limited position. Thus, the door lock is impossible to be unlocked only by a key before the valve rod of the electromagnetic valve is released by the remote controller to disengage from the insert hole of the bolt base, having best effect of anti-theft.

1 Claim, 6 Drawing Sheets

REMOTE-CONTROLLED DOOR LOCK

BACKGROUND OF THE INVENTION

1. Field of the Invention

This invention relates to a remote-controlled door lock, particularly to one able to lock a door by the valve rod of an electromagnetic valve controlled by a remote controller, with the door lock impossible to be unlocked only by a key before the valve rod of the electromagnetic valve is released by a remote controller to disengage from the insert hole of the bolt base of a door jamb, having best effect of anti-theft.

2. Description of the Prior Art

A conventional door lock as shown in FIG. 1, includes a housing 10, a lock base 11, a pull plate 12 and a deadbolt 13.

The lock base 11 is secured in the interior of the housing 10, having lateral lock rods 110 fitted at one side. The lock rods 110 of the lock base 11 are able to extend out of the through holes 100 in a side wall of the housing 10 and engage into an elongate slot 141 in a side wall of the bolt base 140 of a door jamb 14. The lock base 11 has its inner and outer side respectively provided with a lock core 111 having a keyhole 112.

The pull plate 12 has its fixing plate 120 inserted in the slide hole 101 of the housing 10 and combined with the fixing plate 102 of the housing 10. The deadbolt 13 is horizontally fitted inside the housing 10, having one end inserted through the fixing plate 102 of the housing 10 and secured with the fixing plate 120 of the pull plate 12. The deadbolt 13 has one end fitted with a spring 130 and the other end provided with a block 131 protruding out of the through hole 103 in the side wall of the housing 10 to be engaged in an elongate slot 141 in a side wall of the bolt base 140 on the doorjamb 14.

Thus, when a key is inserted in the keyhole 112 of the lock core 111 and turned around, the lock rods 110 and the block 131 will be moved back and disengaged from the elongate slot 141 of the bolt base 140 on the doorjamb 14, thus finishing unlocking of the door lock.

However, a conventional door lock has its lock rods 110 and block 131 locked in the bolt base 140 of the door jamb 14 only by a key so it is easy to be unlocked with some unlocking tools, thus having no effect of anti-theft.

SUMMARY OF THE INVENTION

The objective of the invention is devised to offer a remote-controlled door lock having best effect of anti-theft.

The feature of the invention is that the housing is installed inside with a battery base, a circuit board and an electromagnetic valve. The electromagnetic valve has a lateral valve rod able to extend out of the through hole in a sidewall of the housing and engage in the insert hole in a sidewall of the bolt base of a doorjamb.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
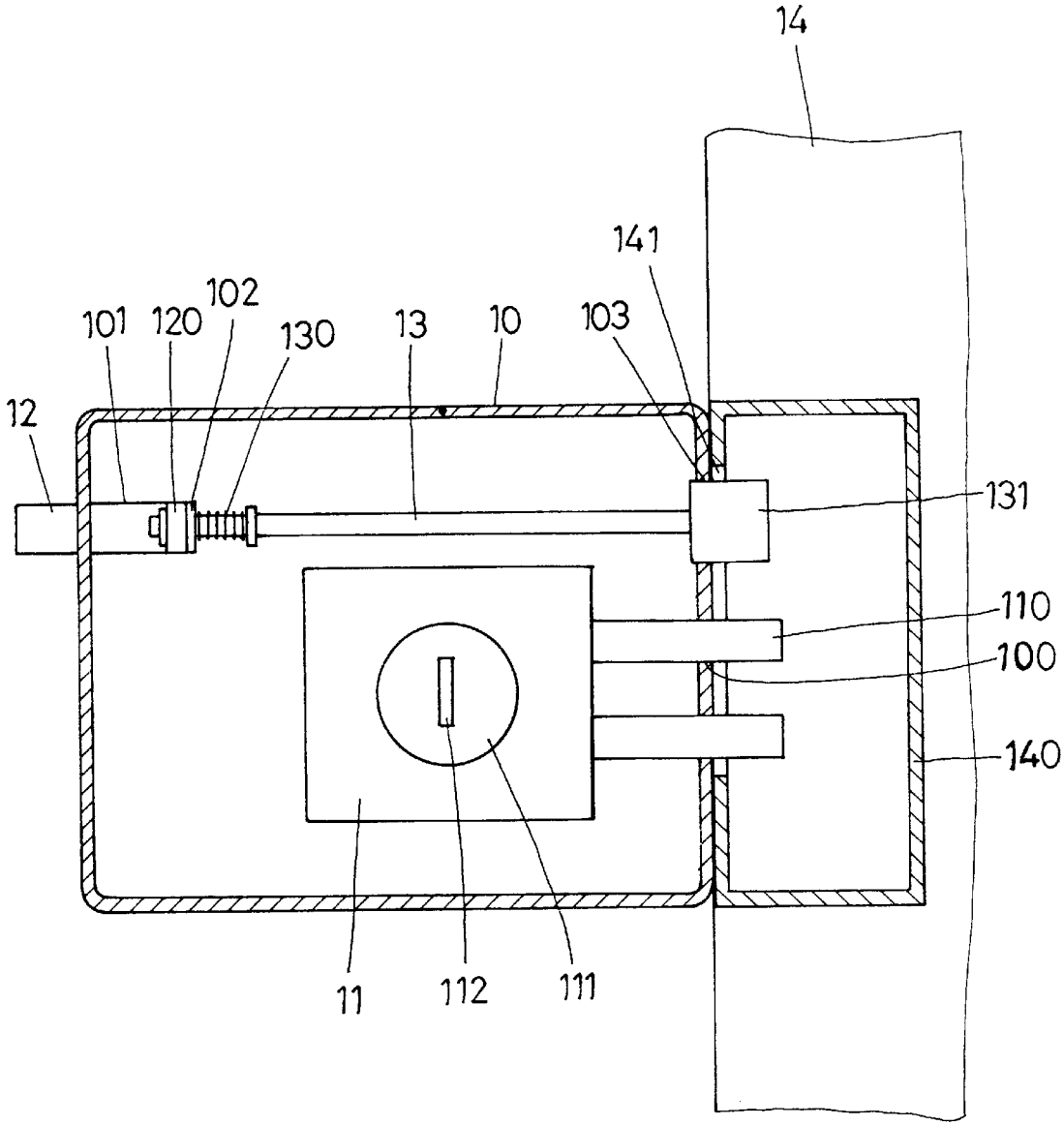
FIG.1 (PRIOR ART)
FIG. 1 is a cross-sectional view of a conventional door lock.
Figure 2:
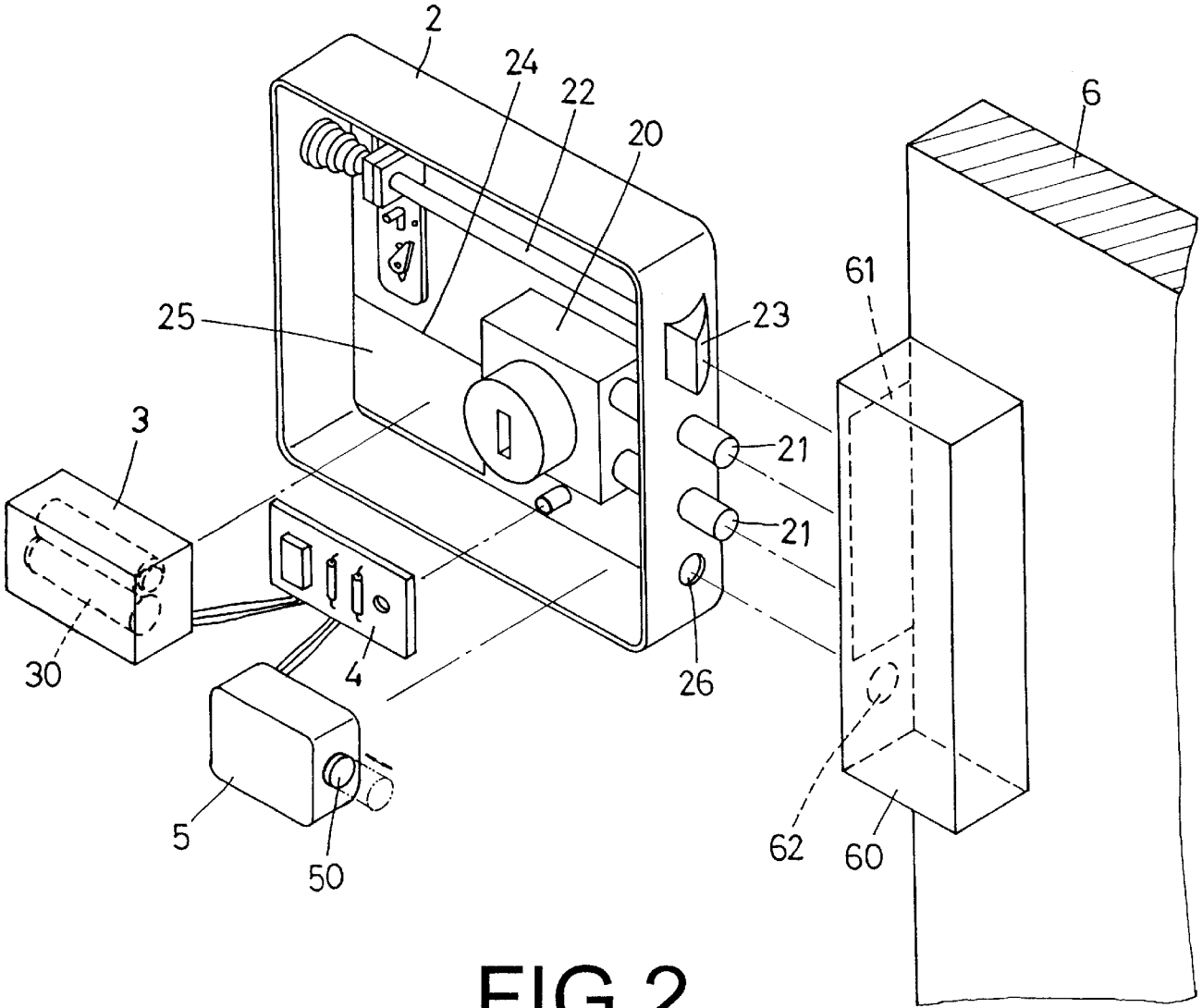
FIG. 2 is an exploded perspective view of a door lock in the present invention.
Figure 3:
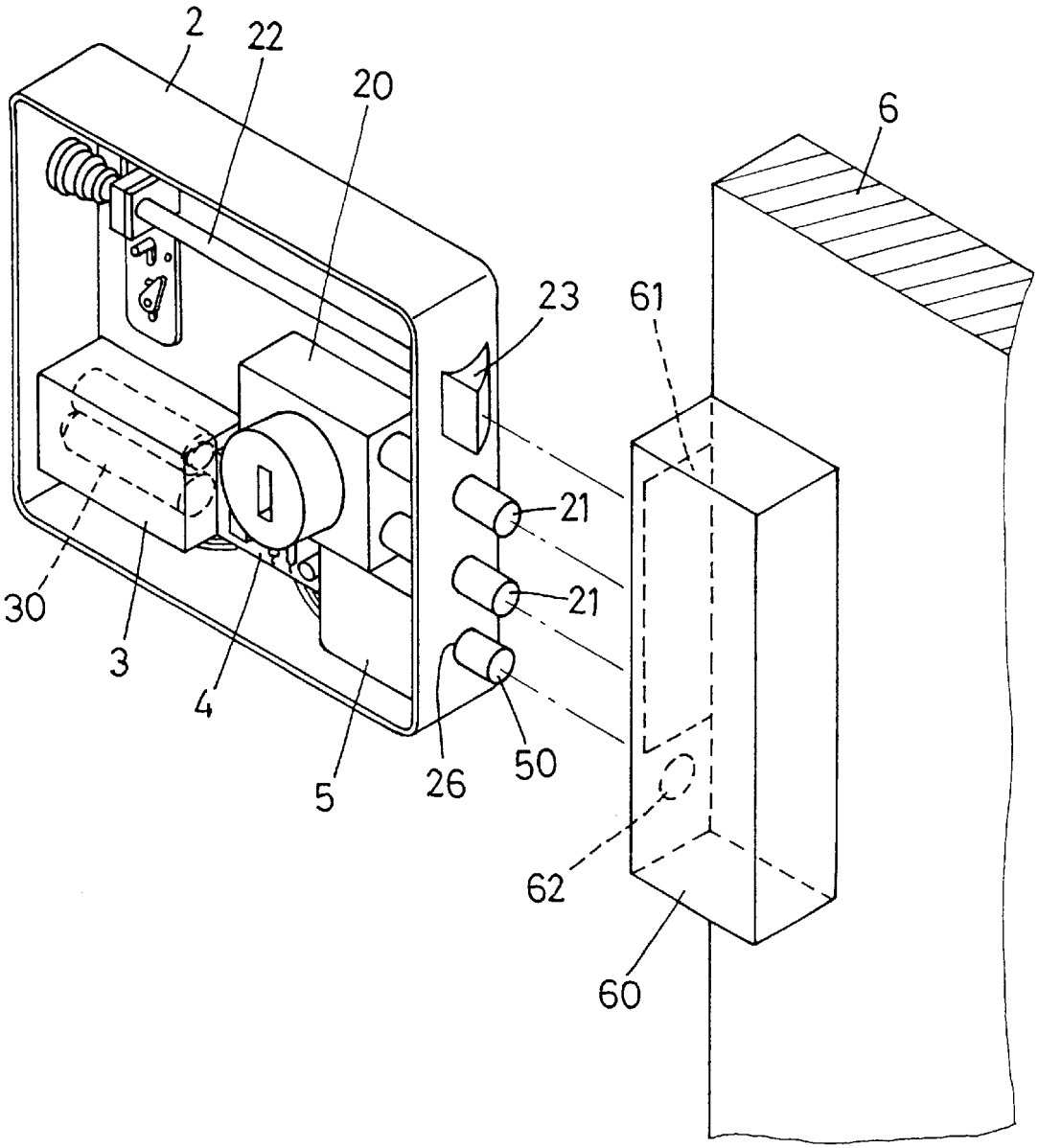
FIG. 3 is a perspective view of the door lock installed in a housing in the present invention.

A preferred embodiment of a remote-controlled door lock in the present invention, as shown in FIGS. 2 and 3, includes a housing 2, a battery base 3, a circuit board 4 and an electromagnetic valve 5 as main components combined together.

The housing 2 is installed inside with a lock base 20 having lock rods 21 able to extend out of the through holes in a side wall of the housing 2. A deadbolt 22 is horizontally fitted in the housing 2, having one end fixed with a block 23 protruding out of the sidewall of the housing 2. The housing 2 has an opening 24 closed by a cover 25.

The battery base 3, the circuit board 4 and the electromagnetic valve 5 are installed in the interior of the housing 2. The battery base 3 has batteries 30 fitted therein and the electromagnetic valve 5 is fitted with a lateral valve rod 50 able to extend out of the through hole 26 in a side wall of the housing 2. Besides, an elongate slot 61 and an insert hole 62 are respectively bored in a sidewall of the bolt base 60 of a door jamb 6, with the elongate slot 61 aligned to the block 23 and the lock rods 21 in the side wall of the housing 2, and the insert hole 62 exactly facing the valve rod 50 of the electromagnetic valve 5.

To lock the door lock, a remote controller is operated to give out a locking signal to the circuit board 4 to start the valve rod 50 of the electromagnetic valve 5 to move outward and extend out of the through hole 26 of the housing 2 and engage in the insert hole 62 of the bolt base 60 of the door jamb 6 to lock a door at a limited position. Under this condition, the door lock is impossible to be unlocked only by a key before the valve rod 50 of the electromagnetic valve 5 is released by a remote controller and disengaged from the insert hole 62 of the bolt base 60.

On the contrary, to unlock the door lock, simply operate a remote-controller to give out an unlocking signal to the circuit board 4 to trigger the valve rod 50 of the electromagnetic valve 5 to move backward and disengage from the insert hole 62 of the bolt base 60, and at this time the door lock can be unlocked by a key.

Figure 4:
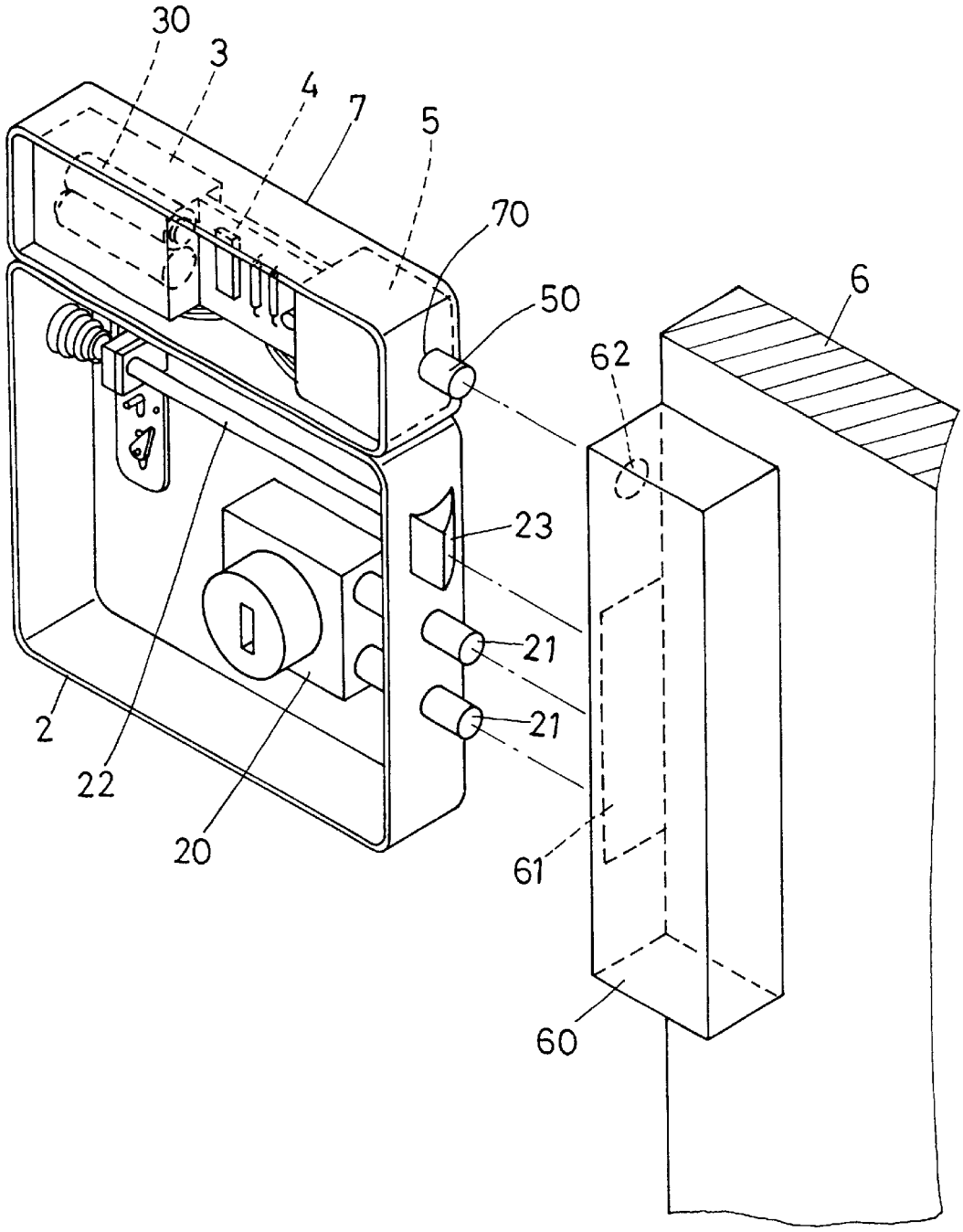
FIG. 4 is a perspective view of the door lock having a control box fixed on the housing in the present invention.
Figure 5:
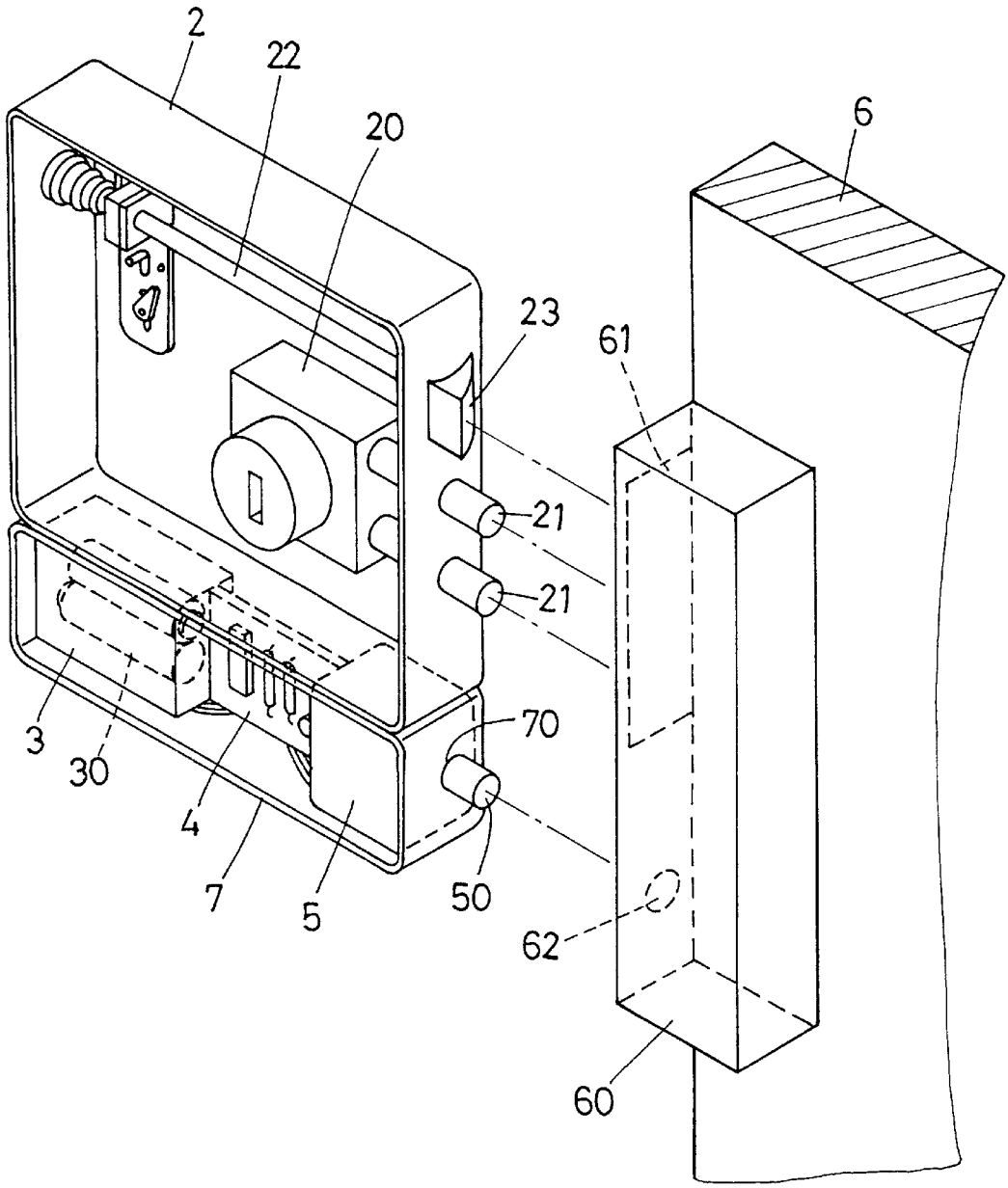
FIG. 5 is a perspective view of the door lock having the control box secured under the bottom of the housing in the present invention; and, FIG. 6 is a perspective view of the door lock installed in the bolt base of a doorjamb in the present invention.

Besides, the battery base 3, the circuit board 4 and the electromagnetic valve 5 originally provided inside the housing 2 can be installed in a control box 7. The control box 7 provided inside with the battery base 3, the circuit board and the electromagnetic valve 5 is fixedly positioned on or under the housing 2, as shown in FIGS. 4 and 5. The valve rod 50 of the electromagnetic valve 5 can move outward and extend out of the through hole 70 in a side wall of the control box 7, aligned to the insert hole 62 in a side wall of the bolt base 60 on a door jamb 6. To lock the door lock, as described above, only operate a remote controller to give out a locking signal to the circuit board 4 to start the valve rod 50 of the electromagnetic valve 5 to move outward and extend out of the through hole 70 of the control box 7 and engage in the insert hole 62 of the bolt base 60 of the door jamb 6, thus finishing locking of a door lock.

Figure 6:
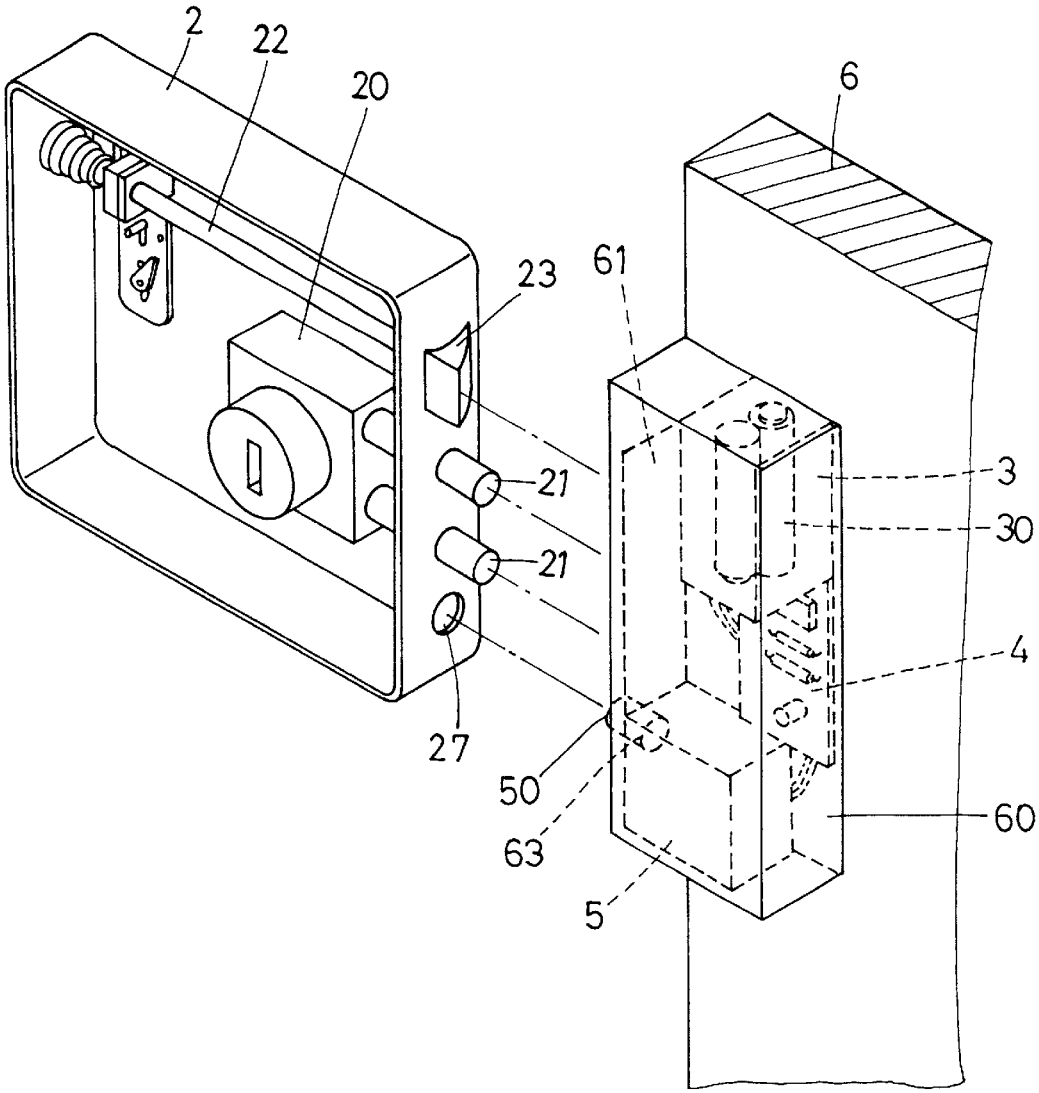

Further, the battery base 3, the circuit board 4 and the electromagnetic valve 4 can be installed in the bolt base 60 of the doorjamb 6, as shown in FIG. 6. The bolt base 60 has a side wall bored with an elongate slot 61 and a through hole

63, with the valve rod 50 of the electromagnetic valve 5 able to extend out of the through hole 63 of the bolt base 60. Then, the housing 2 has one sidewall bored with an insert hole 27 exactly facing the valve rod 50 in the sidewall of the bolt base 60.

To lock the door lock, a remote controller is operated to give out a locking signal to the circuit board 4 to trigger the valve rod 50 of the electromagnetic valve 5 to move outward and extend out of the through hole 63 of the bolt base 60 and engage into the insert hole 27 of the housing 2 to lock a door at a limited position. Thus, the door lock is impossible to be unlocked only by a key before the valve rod 50 of the electromagnetic valve 5 is released by a remote controller to disengage from the insert hole 27 of the housing 2, having best effect of anti-theft.

To unlock the door lock, just operate the remote controller to give out unlocking signal to the circuit board 4, which synchronously starts the valve rod 50 to move inward and disengage from the insert hole 27 of the housing 2, and subsequently the door lock is unlocked by a key.

While the preferred embodiment of the invention has been described above, it will be recognized and understood that various modifications may be made therein and the appended claims are intended to cover all such modifications that may fall within the spirit and scope of the invention.

What is claimed is:

1. A remote-controlled door lock comprising a housing, said housing installed with a lock base in the interior, said lock base provided with at least one lateral lock rod able to extend out of a first through hole in a side wall of said housing, said housing installed inside with a lateral deadlock, said deadlock having one end fixed with a block protruding out of said side wall of said housing, an elongate slot bored in a side wall of a bolt base of a door jamb; and, characterized by said housing installed inside with a battery base, a circuit board and an electromagnetic valve, said electromagnetic valve fitted with a lateral valve rod, said valve rod able to extend out of a second through hole in the side wall of said housing, said bolt base of said door jamb having one side wall bored with an insert hole, said insert hole aligned to said valve rod of said electromagnetic valve, to lock said door lock, a remote controller operated to give out a locking signal, said circuit board receiving said locking signal and starting said valve rod of said electromagnetic valve to move outward and engage in said insert hole in the side wall of said bolt base of said door jamb, said valve rod locking a door at a limited position, said door lock impossible to be unlocked only by a key before said valve rod is released by said remote controller to disengage from said insert hole of said bolt base, to unlock said door lock, said remote controller operated to give out an unlocking signal, said circuit board receiving said unlocking signal and triggering said valve rod of said electromagnetic valve to move backward, said valve rod disengaging from said insert hole of said bolt base, said battery base, said circuit board and said electromagnetic valve are installed in a control box fixedly positioned on said housing, said valve rod of said electromagnetic valve able to extend out of the second through hole in the side wall of said control box, and said bolt base of said door jamb having its upper side wall bored with an insert hole for said valve rod to be inserted therein.

* * * * *